US006800147B2

(12) United States Patent
Nagao et al.

(10) Patent No.: US 6,800,147 B2
(45) Date of Patent: Oct. 5, 2004

(54) HIGH-STRENGTH STEEL WIRE EXCELLING IN RESISTANCE TO STRAIN AGING EMBRITTLEMENT AND LONGITUDINAL CRACKING, AND METHOD FOR PRODUCTION THEREOF

(75) Inventors: Mamoru Nagao, Kobe (JP); Hiroshi Yaguchi, Kobe (JP); Kenji Ochiai, Kobe (JP); Nobuhiko Ibaraki, Kobe (JP); Takaaki Minamida, Kakogawa (JP); Noriaki Hiraga, Kakogawa (JP)

(73) Assignee: Kobe Steel, Ltd., Kobi (JP)

( * ) Notice: Subject to any disclaimer, the term of this patent is extended or adjusted under 35 U.S.C. 154(b) by 69 days.

(21) Appl. No.: 10/226,137

(22) Filed: Aug. 23, 2002

(65) Prior Publication Data

US 2003/0066575 A1 Apr. 10, 2003

(30) Foreign Application Priority Data

Sep. 10, 2001 (JP) ..... 2001-272905

(51) Int. Cl.[7] ..... C22C 38/02; C22C 38/04; C21D 8/06

(52) U.S. Cl. ..... 148/320; 148/330; 148/333; 148/334; 148/335; 148/336; 148/599; 148/598; 428/606

(58) Field of Search ..... 148/320, 330, 148/333–336, 598, 599; 428/606

(56) References Cited

U.S. PATENT DOCUMENTS

| | | | |
|---|---|---|---|
| 5,211,772 | A | 5/1993 | Ashida et al. |
| 5,248,353 | A | 9/1993 | Nishida et al. |
| 5,575,866 | A | 11/1996 | Minamida et al. |
| 5,776,267 | A | 7/1998 | Nanba et al. |
| 5,873,958 | A | 2/1999 | Makii et al. |
| 6,206,984 | B1 | 3/2001 | Inada et al. |
| 6,322,641 | B1 | 11/2001 | Makii et al. |
| 6,372,056 | B1 | 4/2002 | Kuroda et al. |

FOREIGN PATENT DOCUMENTS

| | | |
|---|---|---|
| EP | 0 516 857 | 12/1992 |
| EP | 0 708 182 | 4/1996 |

(List continued on next page.)

OTHER PUBLICATIONS

U.S. patent application Ser. No. 09/971,700, filed Oct. 9, 2001, pending.
U.S. patent application Ser. No. 10/171,593, filed Jun. 17, 2002, pending.

(List continued on next page.)

*Primary Examiner*—Deborah Yee
(74) *Attorney, Agent, or Firm*—Oblon, Spivak, McClelland, Maier & Neustadt, P.C.

(57) ABSTRACT

Disclosed herein is a high-strength high-carbon steel wire which, owing to its high strength as well as good ductility, is excellent in resistance to strain aging embrittlement and longitudinal cracking.

The steel wire is characterized by having a chemical composition (in mass %) including C: 0.75–1.20%, Si: 0.1–1.5%, Mn: 0.3–1.2%, P: no more than 0.02%, S: no more than 0.02%, Al: no more than 0.005%, and N: no more than 0.008%, with the remainder being Fe and inevitable impurities. The steel wire is further characterized by having worked pearlite structure containing lamellar cementite in amorphous form, a diameter (D) ranging from 0.15 to 0.4 mm, a metal lubricating film as the surface layer whose main phase is composed of at least one of Cu, Ni, and Zn or an alloy thereof, and tensile strength no lower than ($3500\times D^{-0.145}$) MPa and no higher than ($3500\times D^{-0.145}+87\times[C]^{-5}$) MPa, where [C] denotes C content in %.

6 Claims, 2 Drawing Sheets

FOREIGN PATENT DOCUMENTS

| | | |
|---|---|---|
| EP | 0 826 782 | 3/1998 |
| FR | 2 792 002 | 10/2000 |
| JP | 6-99746 | 12/1994 |
| JP | 9-99312 | 4/1997 |
| JP | 10-121199 | 5/1998 |
| JP | 11-199978 | 7/1999 |
| JP | 11-199980 | 7/1999 |
| JP | 11-269607 | 10/1999 |
| JP | 2000-63987 | 2/2000 |

OTHER PUBLICATIONS

U.S. patent application Ser. No. 09/971,700, Nagao, et al., filed Oct. 9, 2001.

U.S. patent application Ser. No. 09/926,715, Koike, et al., filed Dec. 6, 2001.

U.S. patent application Ser. No. 10/204,406, Ibaraki, et al., filed Aug. 27, 2002.

U.S. patent application Ser. No. 10/226,137, Nagao, et al., filed Aug. 23, 2002.

HIGH-STRENGTH STEEL WIRE EXCELLING IN RESISTANCE TO STRAIN AGING EMBRITTLEMENT AND LONGITUDINAL CRACKING, AND METHOD FOR PRODUCTION THEREOF

BACKGROUND OF THE INVENTION

1. Field of the Invention

The present invention relates to a high-strength steel wire and a method for production thereof, said steel wire being one which is ready for shipment without heat treatment (such as blueing) after cold working and which finds use for steel cords and wire ropes.

2. Description of the Related Art

Automotive steel tires are reinforced with steel cords or bead wires, which are composed of very thin steel wires twisted together, each being about 0.15 to 0.4 mm in diameter and having high strength in excess of 310 kgf/cm$^2$.

Said steel wire is produced from a hot-rolled wire rod of high-carbon steel (eutectoid steel or hyper-eutectoid steel) by drawing (for reduction in diameter), patenting, acid pickling, brass plating (for metal lubrication), and final wet cold drawing. The resulting steel wire is as thin as about 0.2 mm in diameter. The patenting step is carried out at about 500–550° C. so as to transform the austenite structure into the uniform, fine pearlite structure, thereby imparting toughness to the steel wire.

Recent automotive tires are required to have improved durability, and steel wires for tire cords are required to have higher strength than before. Steel wires can be improved in strength readily by increasing the carbon content. However, high strength should be accompanied by sufficient ductility. Any attempt to improve strength without respect to ductility ends up with a problem with longitudinal cracking—fracture that occurs in the lengthwise direction upon twisting.

Several ideas have been proposed as follows to prevent longitudinal cracking.

Japanese Patent Publication No. 99746/1994 discloses a steel incorporated with Cr and Co which make the pearlite lamellar structure fine.

Japanese Patent Laid-open No. 99312/1997 discloses a method of drawing a steel wire continuously through a die in such a way that the reduction of area is controlled in response to the amount of strain due to drawing.

Japanese Patent Laid-open No. 121199/1998 discloses a steel wire composed mainly of fine pearlite, with its lamellar cementite rendered amorphous.

Japanese Patent Laid-open No. 199980/1999 discloses a steel wire having the pearlite structure such that ferrite contains no more than 1.5 atom % of carbon dissolved therein.

Japanese Patent Laid-open No. 269607/1999 discloses a steel wire in which the amount of cementite is controlled in response to the amount of carbon and the average particle diameter of cementite is 2–10 nm.

OBJECT AND SUMMARY OF THE INVENTION

The above-mentioned prior art technology has achieved to some extent the object of improving strength. There still is a need for further improvement in strength. Unfortunately, a high-carbon steel wire suffers strain aging when it is allowed to stand at room temperature after drawing, and this strain aging increases strength further. [See "Zairyou to Purosesu" (Materials and Processes) CAMP-ISIJ vol. 12 (1999), p. 461.] Increase in strength due to strain aging makes a high-carbon steel wire more vulnerable to longitudinal cracking. This has stimulated the development of a high-strength high-carbon steel wire which has ductility enough to retain good resistance to longitudinal cracking even though strength increases due to strain aging.

The present invention was completed in view of the foregoing problem. It is an object of the present invention to provide a high-strength steel wire and a method for production thereof, said steel wire having high strength as well as sufficient ductility and excelling in resistance to strain aging embrittlement and longitudinal cracking.

Figure 1:
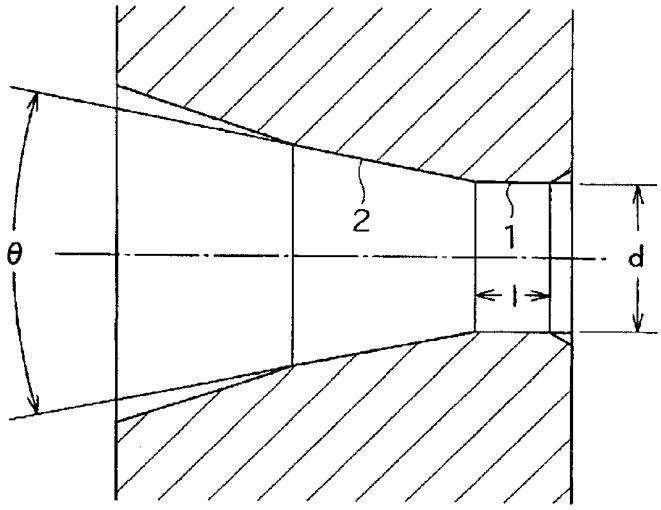
FIG. 1 is a sectional view of the drawing die with reference numbers.

Tensile strength herein is its lower limit expressed by $3500 \times D^{-0.145}$, where D denotes the diameter.

○ denotes those samples which did not suffer longitudinal cracking immediately after final drawing as well as 30 days after final drawing.

Δ denotes those samples which did not suffer longitudinal cracking immediately after final drawing but suffered longitudinal cracking 30 days after final drawing.

X denotes those samples which suffered longitudinal cracking immediately after final drawing.

The present invention is based on the present inventor's finding that a high-strength high-carbon steel wire excelling in resistance to strain aging embrittlement is obtained if a high-carbon steel wire is drawn adequately and so conditioned as to impart a specific structure and a specific magnitude of strength determined by the wire diameter and carbon content.

Moreover, the present invention is based also on the finding that resistance to longitudinal cracking develops when cementite exists in amorphous form and resistance to strain aging develops when cold wet drawing is so performed as to minimize strain aging.

A detailed explanation follows. If the steel wire in question is to have higher strength than conventional one, it should be processed in such a way that it has as high strength as possible after patenting which precedes final drawing. However, there is a limit to strength that is achieved by patenting no matter how patenting is controlled adequately. The only way to impart high strength to the wire is to increase the amount of working by drawing. Working in terms of true strain ($\epsilon$) exceeding 3.0 is inevitable. Wire drawing generates heat due to friction against the die surface, and the amount of heat increases as the wire diameter decreases and hence passes through the die faster. For this reason drawing in the final stage is accomplished by wet drawing, which is drawing with cooling. It has been believed that wet drawing under conventional conditions does not cause strain aging during drawing. However, recent investigations revealed that intensive working, with true strain ($\epsilon$) exceeding 3.0, causes marked embrittlement due to strain aging. This embrittlement causes longitudinal cracking to the finished steel wire immediately after drawing or upon standing for some time at room temperature which deteriorates ductility.

The foregoing finding and knowledge led to the present invention. The first aspect of the present invention resides in a high-strength high-carbon steel wire which is characterized by having a chemical composition (in mass %) including C: 0.75–1.20%
Si: 0.1–1.5%
Mn: 0.3–1.2%
P: no more than 0.02%
S: no more than 0.02%
Al: no more than 0.005%
N: no more than 0.008% with the remainder being Fe and inevitable impurities, worked pearlite structure containing lamellar cementite in amorphous form, a diameter (D) ranging from 0.15 to 0.4 mm, a metal lubricating film as the surface layer whose main phase is composed of at least one of Cu, Ni, and Zn or an alloy thereof, and tensile strength no lower than $3500\times D^{-0.145}$ MPa and no higher than $(3500\times D^{-0.145}+87\times[C]^{-5})$ MPa, where [C] denotes C content in %. The present invention may be modified such that the chemical composition additionally includes individually or in combination:

(1) at least one of Ni: 0.10–1.0%, Cr: 0.10–1.0%, and Mo: 0.10–0.5%
(2) Cu: no less than 0.05% and less than 0.20%
(3) Co: no more than 2.0%
(4) B: 0.0003–0.0050%

The second aspect of the present invention resides in a method of producing a high-strength steel wire by drawing a hot-rolled wire rod, subjecting the drawn wire to patenting and acid pickling, forming thereon a metal lubricating film whose main phase is composed of at least one of Cu, Ni, and Zn or an alloy thereof, and performing final drawing to reduce the diameter(D) to 0.15–0.4 mm, wherein the steel wire has the chemical composition specified above, the patenting treatment is carried out under the condition that the treated steel wire has a tensile strength no lower than $(540\times[C]+1055)$ MPa and no higher than $(540\times[C]+1065)$ MPa, where [C] denotes C content in %, and the final drawing is either cold wet drawing for a pass which results in a true strain ($\epsilon$) in excess of 2.0 or drawing through a diamond die for a pass which results in a true strain ($\epsilon$) in excess of 3.0, said drawing being so carried out as to satisfy at least two of the following four conditions:

(1) the diamond die has an approach angle of 6–12 degrees.
(2) the diamond die has a bearing section whose length is 0.3 d to 0.5 d, where d denotes its inside diameter.
(3) the wet drawing employs a lubricant which is controlled at 35±10° C.
(4) drawing through the diamond die is carried out such that the reduction of area is no more than 20%.

and the final drawing is carried out at a drawing rate specified by DV which is no larger than 200 mm·m/min, where D denotes the diameter (in mm) of the steel wire and V denotes the drawing rate (in m/min).

DESCRIPTION OF THE PREFERRED EMBODIMENTS

The high-strength steel wire according to the present invention is characterized by having a chemical composition (in mass %) including C: 0.75–1.20%
Si: 0.1–1.5%
Mn: 0.3–1.2%
P: no more than 0.02%
S: no more than 0.02%
Al: no more than 0.005%
N: no more than 0.008% with the remainder being Fe and inevitable impurities. The content of each component was specified on the following ground.

C: 0.75–1.20%

Carbon is an inexpensive element and yet effectively contributes to strength. Carbon increases the amount of work hardening at the time of drawing and also increases strength after drawing in proportion to its content. With an excessively low carbon content, the resulting steel wire will contain ferrite more than necessary. Thus, the present invention requires the lower limit of carbon content to be 0.75%, preferably 0.80%. With an excessively high carbon content, the resulting steel wire is liable to fracture at the time of drawing owing to precipitation of net-like pro-eutectoid cementite in austenite boundaries, and the finished fine steel wire has extremely poor toughness and ductility. Thus, the present invention requires the upper limit of carbon content to be 1.20%, preferably 1.10%.

Si: 0.1–1.5%

Silicon functions as an effective deoxidizing agent. In the present invention which deals with an aluminum-free steel wire, silicon plays an important role. The present invention requires the lower limit of silicon content to be 0.1%. Silicon in an amount less than 0.1% does not fully produce its deoxidizing effect. The present invention requires the upper limit of silicon content to be 1.5%, preferably 1.0%, and more preferably 0.5%. Silicon in an excess amount presents difficulties in wire drawing by mechanical descaling (MD for short hereinafter).

Mn: 0.3–1.2%

Manganese also functions as an effective deoxidizing agent like silicon. In the present invention which deals with a steel wire intentionally freed of aluminum, manganese should be used in combination with silicon for complete deoxidizing. Manganese combines with sulfur in steel to form MnS, thereby improving the toughness and ductility of steel. It also improves the hardenability of steel and decreases the amount of pro-eutectoid cementite in rolled products. The present invention requires the lower limit of manganese content to be 0.3%, preferably 0.4%. On the other hand, manganese is liable to segregation and hence manganese in an excess amount gives rise to super-cooled structure, such as martensite and bainite, in the region of manganese segregation, thereby deteriorating drawability. For this reason, the present invention requires the upper limit of manganese content to be 1.2%, preferably 1.0%.

P: no more than 0.02%
S: no more than 0.02%
N: no more than 0.008%

These impurity elements should be as little as possible because they deteriorate ductility. Therefore, the upper limit of the content of these elements is specified as above. Incidentally, nitrogen combines with boron (mentioned later) to form BN, thereby reducing the amount of dissolved boron. In the case where boron is added, the nitrogen content should be no more than 0.0050%, preferably no more than 0.0035%.

Al: no more than 0.005%

Aluminum functions as an effective deoxidizing agent. It forms $Al_2O_3$. This non-metallic inclusion deteriorates ductility and seriously impedes drawability. Therefore, the present invention requires the aluminum content to be no more than 0.005%.

The steel wire of the present invention contains, in addition to the above-mentioned components, iron (as the remainder) and inevitable impurities. For improvement in quality, it may be incorporated with one or more additional components selected from the following in an amount not harmful to the effects and functions of the basic components. (1) at least one of Ni, Cr, and Mo, (2) Cu, (3) Co, and (4) B. There contents are specified below.

Ni: 0.10–1.0%

Cr: 0.10–1.0%

Mo: 0.10–0.5%

These elements reduce the interstice of cementite in pearlite formed by patenting treatment, thereby contributing to tensile strength and drawability. The lower limit of their content should be 0.10%. With an amount less than this limit, they do not produce their effects. The upper limit of their content should be 1.0% (for Ni and Cr) and 0.5% (for Mn) because their effect levels off when they are added in excess of their upper limit. In particular, Cr in an excess amount tends to form undissolved cementite, thereby causing steel to take a prolonged time to complete transformation. Moreover, it would give rise to super-cooled structure, such as martensite and bainite, in the hot-rolled wire rod.

Cu: no less than 0.05% and less than 0.20%

Copper imparts good corrosion resistance to fine steel wires, improves descalability, and prevents die seizure. The lower limit of copper content for desired effects should be 0.05%, and the upper limit of copper content without adverse effects should be 0.20%, preferably 0.10%. Copper added in an excess amount causes blistering to the surface of wire rod when the hot-rolled wire rod is rested even though the resting temperature is as high as about 900° C. Blistering forms magnetite in the steel under blisters, deteriorating mechanical descalability. Moreover, copper reacts with sulfur to segregate CuS in grain boundaries, thereby causing flaws to the ingot and wire rod during production of steel wire.

Co: no more than 2.0%

Cobalt suppresses the formation of pro-eutectoid cementite, thereby improving ductility and drawability. The lower limit of cobalt content should be 2.0%. Cobalt added in an excess amount makes patenting to take a longer time for pearlite transformation, thereby reducing productivity.

B: 0.0003–0.0050%

Free boron (in the form of solid solution) suppresses the formation of ferrite. The lower limit of boron content (as total boron) necessary to ensure free boron is 0.0003%. The upper limit of boron content is 0.0050%, preferably 0.0040%. Boron added in an excess amount forms $Fe_{23}(CB)_6$, thereby impeding drawability. Boron that suppresses the formation of ferrite is not added boron but free boron which forms no compounds in steel. For boron to remain free, it should not form BN. Since the nitrogen content according to the present invention is no more than 0.0085, preferably no more than 0.0050%, and more preferably no more than 0.0035%, it is possible to ensure as much free boron as necessary. Free boron in an amount of at least 0.0003% is necessary to prevent the formation of ferrite; however, the upper limit of free boron is determined naturally by the amount of boron added.

The steel wire of the present invention has a worked pearlite structure in which the lamellar cementite is amorphous. The pearlite structure is most suitable for drawing among the structures of steel materials. In other words, it is most suitable for fine steel wires (0.15–0.4 mm in diameter) as specified in the present invention. The fact that the lamellar cementite in the pearlite structure is amorphous contributes to high toughness and good ductility and hence improves resistance to longitudinal cracking even though the steel wire has high strength.

The term "amorphous" used above is defined rather loosely according to any one of the following three states.

(1) In observation under a transmission electron microscope (TEM), the sample merely gives a halo pattern in the diffraction pattern taken by using a thin beam smaller than 1 nm in diameter and the lattice fringe image shows no indication of crystals.

(2) In Mössbauer spectrometry, the lamellar cementite gives a Mössbauer spectrum in which the relation Pf<Psp is satisfied, where Pf denotes the maximum value to represent ferromagnetic components and Psp denotes the maximum value to represent paramagnetic components.

(3) In X-ray diffractometry, the lamellar cementite gives an X-ray diffraction pattern in which the half width (2θ) of the maximum peak is greater than 3 rad.

To make amorphous the lamellar cementite in the structure, it is necessary to carry out the final drawing of steel wire with cooling in such a way that one pass gives a true strain (ε) greater than 2.0. According to the method of the present invention, the final drawing employs cold wet drawing for true strain (ε) greater than 2.0 or drawing through a diamond die for true strain (ε) greater than 3.0.

The steel wire of the present invention has a metal lubricating film formed thereon. This film is a residue of the metal lubricant applied to the steel wire after patenting and before final drawing. The lubricant is necessary to protect the die from wearing and deterioration during drawing involving intensive working. The metal lubricating film may be formed by plating with Cu, Zn, or Ni (for economical reason) or from an alloy thereof (such as brass). Incidentally, brass or copper plated film helps the steel wire used as tire cords to adhere to rubber.

The steel wire of the present invention should have a specific tensile strength (TS) no lower than $(3500\times D^{-0.145})$ MPa and no higher than $(3500\times D^{-0.145}+87\times[C]^{-5})$ MPa, where [C] denotes the carbon content in mass %. The range of TS was established on the basis of the following facts which are shown in Examples given later. With TS smaller than the lower limit, the steel wire has good resistance to longitudinal cracking immediately after final drawing but becomes liable to longitudinal cracking with the lapse of time owing to strain aging embrittlement. By contrast, with TS greater than the upper limit, the steel wire is much liable to longitudinal cracking immediately after final drawing or eventually suffers longitudinal cracking with the lapse of time owing to strain aging embrittlement. It should be noted that the upper limit of TS depends on the amount of carbon in the steel wire. The reason why the lower limit of TS is not affected by carbon content is that resistance to longitudinal cracking is affected more strongly by wire diameter than by carbon content. On the other hand, the reason why the upper limit of TS is affected by carbon content is that resistance to strain aging is strongly affected by carbon content in the base metal.

The steel wire of the present invention is produced by the process which is explained in the following. The process starts with preparation of an ingot having the chemical composition mentioned above. The ingot is made into billets by blooming. The billet is hot-rolled to give a steel wire rod. The wire rod undergoes intermediate patenting and intermediate drawing to give a steel wire which has a diameter suitable for final drawing. The steel wire undergoes final patenting and acid pickling and coated with a metal lubricating film. The steel wire is drawn into a thin steel wire (0.15–4.0 mm in diameter) by cold wet drawing as the final drawing. Incidentally, the final drawing consists of sequential steps of passing the steel wire (which has undergone final patenting) through a series of dies until the drawn wire has a desired diameter (0.15–4.0 mm).

The hot-rolled wire rod should have a diameter of about 3.5–10 mm. It will be poor in productivity if it is thinner than 3.5 mm, and it will be poor in drawability if it is thicker than 10 mm. On the other hand, the steel wire which undergone intermediate drawing (or patenting) should have a diameter of about 1.0–2.5 mm. It will present difficulties in drawability in final drawing if it is thinner than 1.0 mm, and it will present difficulties in patenting (to control the structure down to the center of the steel wire) if it is thicker than 2.5 mm. The latter case leads to poor drawability.

The patenting is heat treatment to make the structure into fine pearlite. This heat treatment is accomplished by keeping the steel wire at the austenitizing temperature and then keeping it at the transformation temperature after cooling. The austenitizing temperature should preferably be about 850–1050° C. Heat treatment below 850° C. will not bring about austenitizing readily; heat treatment above 1050° C. forms surface scale and makes crystal grains coarser, thereby deteriorating drawability. The austenitizing step should last for 10–75 seconds. Duration shorter than 10 seconds is not enough for complete heating; duration longer than 75 seconds is detrimental to drawability due to formation of surface scale and coarsening of crystal grain. On the other hand, the transformation temperature should be about 550–565° C. Heating below 550° C. makes bainite dominant in the structure, which leads to poor drawability. Heating above 565° C. prevents the formation of fine pearlite, decreasing the strength of the steel wire after patenting, with the result that the steel wire after final drawing lacks desired strength. Heating at 550–565° C. for about 10–80 seconds permits the steel wire to have strength in a narrow range from (540×[C]+1050) MPa to (540° C.[C]+1065) MPa in response to the carbon content [C]. This means that the steel wire can be made into fine steel wire in a stable manner by final drawing.

The final drawing is accomplished by cold wet drawing so that the lamellar cementite of fine pearlite is made amorphous. The lamellar cementite can be made amorphous only when final drawing (to give a true strain ($\epsilon$) in excess of 3.0) is carried out with cooling. Therefore, cold wet drawing is employed as final drawing. In addition, the present invention requires that the final drawing should employ a diamond die with good heat conductivity so as to reduce heat generation due to drawing and promote decrystallization.

According to the present invention, it is necessary to use a diamond die for final drawing to give a true strain ($\epsilon$) in excess of 3.0, and it is also necessary to carry out drawing so as to satisfy at least two of the following four conditions.

(1) the diamond die has an approach angle of 6–12 degrees.
(2) the diamond die has a bearing section whose length is 0.3 d to 0.5 d, where d denotes its inside diameter.
(3) the wet drawing employs a lubricant which is controlled at 35±10° C.
(4) the reduction of area is no more than 20%.

These conditions are intended to prevent decrystallized lamellar cementite from recrystallizing due to heat generated during high-speed drawing by friction between the steel wire and the die. They are also intended to suppress strain aging during drawing and to promote cooling during drawing.

Incidentally, the approach angle ($\theta$) mentioned above is the angle of the tapered surface of the approach section 2 (or reduction section) through which the steel wire is introduced into the bearing section 1 (minimum aperture section) of the die which determines the wire diameter after drawing, as shown in FIG. 1. The length of the bearing section mentioned above denotes the length 1 along the direction of drawing in the bearing section 2. The bearing section has an inside diameter d which remains virtually unchanged along the direction of drawing.

According to the present invention, drawing should be carried out such that the value of VD (which is a product of D [the diameter in mm of the steel wire] and V [the drawing rate in m/min]) is no larger than 200 mm·m/min, preferably no larger than 150 mm·m/min, more preferably no larger than 100 mm·m/min. Even thought the above-mentioned cooling means is provided, drawing with a value of VD exceeding 200 will result in strain aging and decomposition of amorphous cementite due to heat generation during drawing with a true stain in excess of 3.0.

The present invention will be described in more detail with reference to the following examples, which are not intended to restrict the scope thereof.

EXAMPLES

Steel samples each having the chemical composition shown in Table 1 were prepared by converter process and ensuing secondary steelmaking. Each steel sample was made into ingots by continuous casting, and the ingot was made into billets by blooming. The billet was made into wire rods (3.5 to 10.0 mm in diameter) by hot rolling, which was followed by conditioning cooling.

The hot-rolled wire rod underwent intermediate drawing and intermediate patenting to give a steel wire having a diameter of 1.0–2.5 mm. This steel wire underwent final patenting under the condition shown in Table 2. The resulting steel wire has tensile strength (TS) as shown in Table 2. Incidentally, the upper and lower limits of tensile strength specified in the present invention are also shown in Table 2.

The patented steel wire underwent acid pickling and subsequent coating with the material (metal lubricant) shown in Tables 3 and 4. At last, the coated steel wire underwent final drawing (cold wet drawing) to give an extremely fine steel wire (filament) having a final diameter D (in mm). Incidentally, Tables 3 and 4 also show the value of the product of V and D, where V is the drawing rate (m/min) in final drawing and D is the diameter.

The wet drawing was carried out by using a cemented carbide die for pass to give a true strain ($\epsilon$) smaller than 3 or by using a diamond die for pass to give a true strain ($\epsilon$) larger than 3. Also, drawing for pass to give a true strain ($\epsilon$) larger than 3 was carried out under the following conditions (1) to (4) and (1') to (4'). The conditions (1) to (4) meet the requirements of the present invention, and the conditions (1') to (4') are intended for comparison. The mark ○ in Tables 3 and 4 indicates that drawing was carried out under any of the conditions (1) to (4) and the blank indicates that drawing was carried out under any of the conditions (1') to (4').

Drawing conditions according to the present invention:

(1) The diamond die has an approach angle of 8 degrees.
(2) The diamond die has a bearing length equal to 0.4 d, where d is the inside diameter.
(3) The wet drawing employs a liquid lubricant kept at 35±5° C.
(4) Drawing through the diamond die is carried out such that the reduction of area is 18%.

Drawing conditions for comparison:

(1') The diamond die has an approach angle of 14 degrees.
(2') The diamond die has a bearing length equal to 0.6 d, where d is the inside diameter.

(3') The wet drawing employs a liquid lubricant kept at 15±5° C.

(4') Drawing through the diamond die is carried out such that the reduction of area is 22%.

The finished steel wire, which had undergone final drawing under the above-mentioned conditions, was examined for structure under a TEM. Whether the lamellar cementite in the pearlite structure is amorphous or not was judged from the diffraction pattern taken by projecting a beam (1.0 nm in radius) to the sample. (A halo pattern suggests the presence of an amorphous structure.) The finished steel wire was also tested for tensile strength (TS) and longitudinal cracking due to twisting. Twisting test was carried out in the following manner.

A specimen (200 times the diameter in length) is taken from the finished steel wire immediately (5 hours) after final drawing. The specimen is twisted until longitudinal cracking occurs, and the number of twists is recorded. If the specimen remains intact after about 30 twists, the number of twists is recorded.

After 30 days, the sample of steel wire was tested again for tensile strength and longitudinal cracking (by twisting). The results are shown in Tables 3 and 4. According to the present invention, the steel wire immediately after final drawing should have tensile strength within the upper and lower limits shown in Tables 3 and 4.

Figure 2:
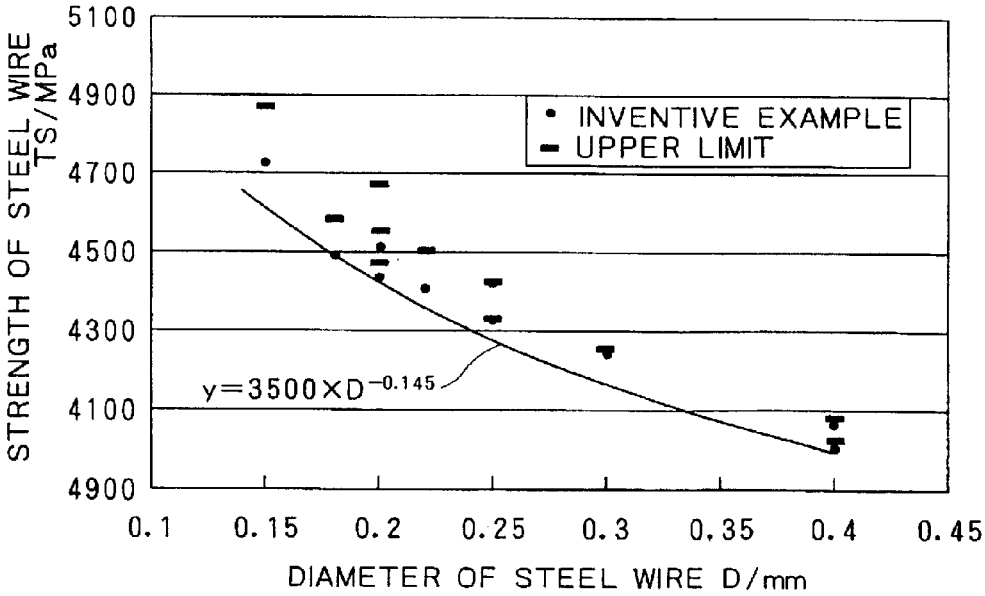
FIG. 2 is a graph showing how the steel wire of the present invention (after final drawing) changes in tensile strength (in MPa) in response to diameter (D mm).
Figure 3:
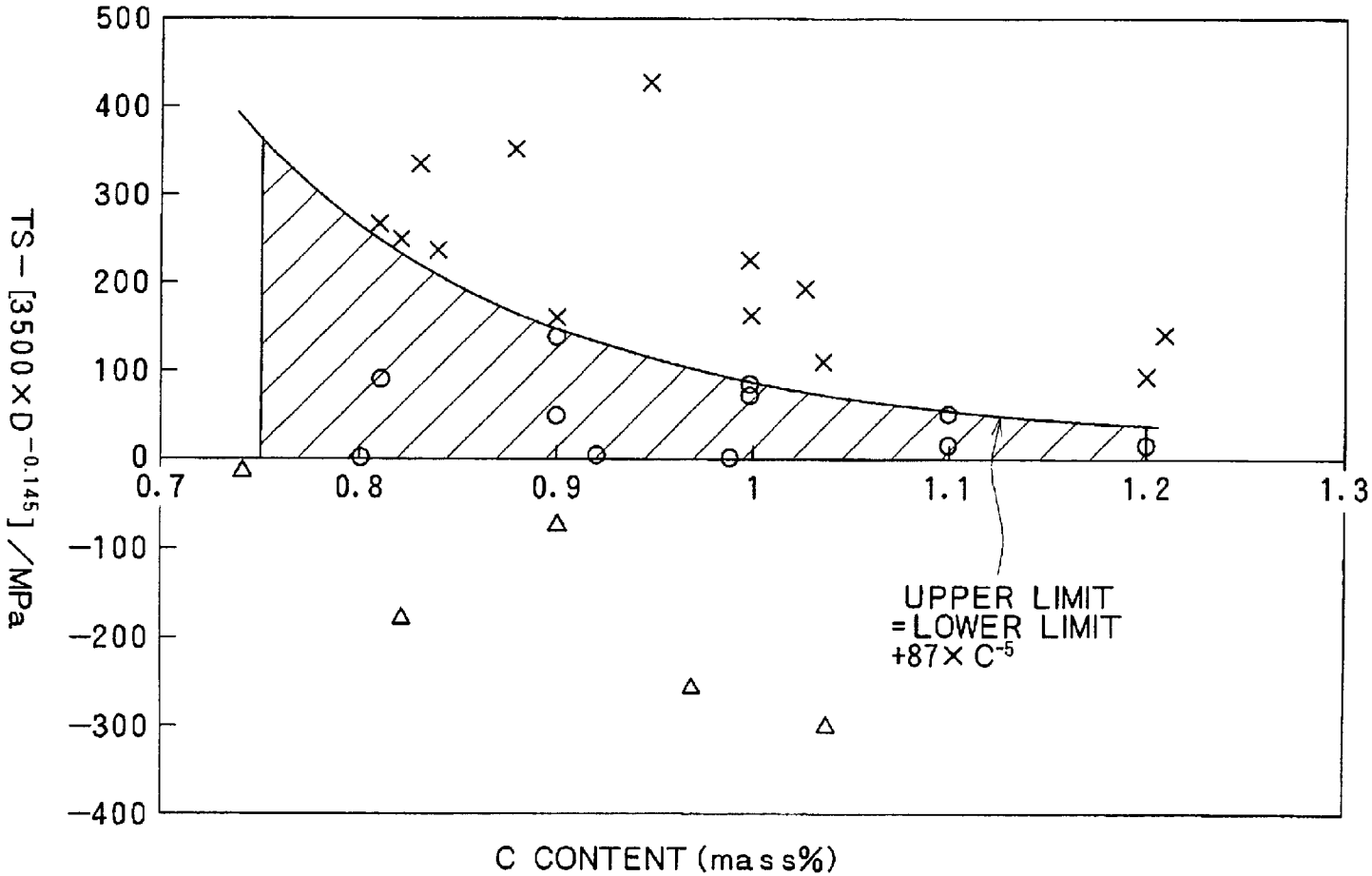
FIG. 3 is a graph showing how the steel wire of the present invention (after final drawing) changes in tensile strength (in MPa) in response to carbon content (mass %).

The steel wire meeting the requirements of the present invention has tensile strength (in MPa) which varies with diameter (D mm) as shown in FIG. 2. In addition, the samples of steel wire in Inventive examples and Comparative Examples have tensile strength (defined as $3500\times D^{-0.145}$ MPa) which varies with carbon content (in mass %) as shown in FIG. 3.

TABLE 1

| Steel | Chemical composition (mass %, remainder Fe) | | | | | | | | | | | | | |
|---|---|---|---|---|---|---|---|---|---|---|---|---|---|---|
| No. | C | Si | Mn | P | S | Al | Ni | Cr | Mo | Co | Cu | B | N | Remarks |
| 1 | 0.80 | 0.30 | 0.010 | 0.010 | 0.010 | 0.0030 | 0 | 0 | 0 | 0.0 | 0 | 0 | 0.0040 | * |
| 2 | 0.81 | 0.25 | 0.54 | 0.006 | 0.008 | 0.0030 | 0 | 0 | 0 | 0.1 | 0 | 0 | 0.0047 | * |
| 3 | 0.90 | 0.60 | 0.50 | 0.004 | 0.004 | 0.0030 | 0 | 0 | 0 | 0.0 | 0 | 0 | 0.0046 | * |
| 4 | 1.00 | 0.20 | 0.30 | 0.007 | 0.006 | 0.0030 | 0 | 0.2 | 0 | 0.0 | 0.07 | 0 | 0.0039 | * |
| 5 | 1.00 | 0.19 | 0.35 | 0.006 | 0.005 | 0.0020 | 0 | 0.2 | 0 | 0.0 | 0.05 | 0 | 0.0044 | * |
| 6 | 1.10 | 0.20 | 0.40 | 0.009 | 0.005 | 0.0030 | 0 | 0.3 | 0 | 0.0 | 0.08 | 0.0030 | 0.0037 | * |
| 7 | 1.20 | 0.15 | 0.56 | 0.009 | 0.007 | 0.0020 | 0 | 0 | 0 | 2.0 | 0.18 | 0 | 0.0030 | * |
| 8 | 0.92 | 0.15 | 0.40 | 0.006 | 0.008 | 0.0020 | 0 | 0 | 0 | 1.0 | 0 | 0 | 0.0038 | * |
| 9 | 0.99 | 0.19 | 0.35 | 0.004 | 0.003 | 0.0030 | 0 | 0.2 | 0 | 0.0 | 0 | 0 | 0.0044 | * |
| 10 | 1.10 | 0.15 | 0.39 | 0.007 | 0.006 | 0.0030 | 0 | 0.2 | 0 | 0.0 | 0 | 0 | 0.0048 | * |
| 11 | 0.90 | 0.17 | 0.53 | 0.007 | 0.005 | 0.0030 | 0 | 0 | 0.1 | 0.0 | 0 | 0 | 0.0044 | * |
| 21 | 0.74 | 1.15 | 0.70 | 0.009 | 0.009 | 0.0030 | 0 | 0.9 | 0.3 | 0.0 | 0.14 | 0 | 0.0039 | ** |
| 22 | 1.21 | 0.12 | 0.32 | 0.008 | 0.008 | 0.0030 | 0 | 0 | 0 | 0.0 | 0 | 0 | 0.0021 | ** |
| 23 | 0.82 | 1.60 | 0.50 | 0.010 | 0.010 | 0.0040 | 0 | 0 | 0.1 | 0.0 | 0 | 0 | 0.0048 | ** |
| 24 | 0.83 | 0.50 | 1.30 | 0.010 | 0.010 | 0.0030 | 0 | 0 | 0.5 | 0.0 | 0.12 | 0 | 0.0050 | ** |
| 25 | 0.81 | 0.40 | 0.70 | 0.030 | 0.030 | 0.0030 | 0 | 0 | 0 | 0.0 | 0 | 0 | 0.0047 | ** |
| 26 | 0.84 | 0.30 | 0.40 | 0.010 | 0.010 | 0.0100 | 0 | 0 | 0 | 0.0 | 0 | 0 | 0.0044 | ** |
| 27 | 0.90 | 0.20 | 0.40 | 0.007 | 0.007 | 0.0020 | 0.09 | 0 | 0.6 | 0.0 | 0 | 0 | 0.0033 | ** |
| 28 | 0.90 | 0.20 | 0.50 | 0.007 | 0.006 | 0.0020 | 1.10 | 0 | 0 | 0.0 | 0.18 | 0 | 0.0039 | ** |
| 29 | 1.03 | 0.20 | 0.40 | 0.007 | 0.004 | 0.0030 | 0 | 0.09 | 0.05 | 0.0 | 0 | 0 | 0.0038 | ** |
| 30 | 1.04 | 0.30 | 0.60 | 0.007 | 0.007 | 0.0030 | 0 | 1.10 | 0 | 0.0 | 0 | 0 | 0.0045 | ** |
| 31 | 1.20 | 0.13 | 0.33 | 0.006 | 0.006 | 0.0020 | 0 | 0 | 0 | 0.0 | 0.20 | 0 | 0.0048 | ** |
| 32 | 1.00 | 0.25 | 0.51 | 0.007 | 0.004 | 0.0020 | 0 | 0 | 0 | 0.0 | 0.08 | 0.0049 | 0.0031 | ** |
| 33 | 1.00 | 0.24 | 0.50 | 0.004 | 0.003 | 0.0030 | 0 | 0 | 0 | 0.0 | 0 | 0.0052 | 0.0029 | ** |
| 34 | 0.82 | 0.36 | 0.87 | 0.009 | 0.007 | 0.0030 | 0 | 0 | 0 | 0.0 | 0 | 0.0002 | 0.0047 | ** |
| 35 | 0.95 | 0.16 | 0.48 | 0.007 | 0.004 | 0.0020 | 0 | 0 | 0 | 0.0 | 0 | 0 | 0.0095 | ** |
| 36 | 0.88 | 0.14 | 0.90 | 0.004 | 0.004 | 0.0024 | 0 | 0 | 0 | 0.0 | 0 | 0 | 0.0003 | ** |
| 37 | 0.94 | 0.22 | 0.40 | 0.007 | 0.007 | 0.0010 | 0 | 0.19 | 0 | 0.0 | 0 | 0 | 0.0032 | ** |
| 38 | 0.97 | 0.20 | 0.50 | 0.006 | 0.003 | 0.0020 | 0 | 0.22 | 0 | 0.0 | 0 | 0 | 0.0041 | ** |
| 39 | 1.04 | 0.19 | 0.31 | 0.007 | 0.006 | 0.0030 | 0.10 | 0 | 0 | 0.0 | 0 | 0 | 0.0036 | ** |

*Inventive example, **Comparative Example

TABLE 2

| | | | | Conditions of final patenting | | | | | | | |
|---|---|---|---|---|---|---|---|---|---|---|---|
| | | | | | | | | TS of patented steel wire (MPa) | | | |
| Sample No. | Steel No. | Diameter of rolled wire (mm) | Diameter of patented wire (mm) | Heating temp. (° C.) | Duration of treatment(s) | Bath temperature (° C.) | Bath dipping time(s) | Measured | Lower limit | Upper limit | Remarks |
| 1 | 1 | 5.5 | 1.00 | 880 | 26 | 560 | 10 | 1490 | 1487 | 1497 | * |
| 2 | 2 | 3.5 | 1.70 | 880 | 44 | 560 | 20 | 1495 | 1492 | 1502 | * |
| 3 | 3 | 5.0 | 1.70 | 900 | 44 | 560 | 20 | 1550 | 1541 | 1551 | * |
| 4 | 4 | 5.5 | 1.50 | 940 | 39 | 560 | 30 | 1603 | 1595 | 1605 | * |
| 5 | 5 | 10.0 | 1.80 | 940 | 39 | 550 | 80 | 1598 | 1595 | 1605 | * |
| 6 | 6 | 6.4 | 1.40 | 950 | 37 | 560 | 30 | 1652 | 1549 | 1659 | * |
| 7 | 7 | 6.4 | 2.50 | 1050 | 65 | 560 | 30 | 1705 | 1703 | 1713 | * |
| 8 | 8 | 5.5 | 1.70 | 900 | 25 | 560 | 30 | 1555 | 1552 | 1562 | * |
| 9 | 9 | 5.5 | 1.30 | 940 | 25 | 560 | 30 | 1597 | 1590 | 1600 | * |

TABLE 2-continued

| Sample No. | Steel No. | Diameter of rolled wire (mm) | Diameter of patented wire (mm) | Conditions of final patenting: Heating temp. (° C.) | Duration of treatment(s) | Bath temperature (° C.) | Bath dipping time(s) | TS of patented steel wire (MPa): Measured | Lower limit | Upper limit | Remarks |
|---|---|---|---|---|---|---|---|---|---|---|---|
| 10 | 10 | 5.5 | 1.30 | 940 | 30 | 560 | 30 | 1650 | 1649 | 1659 | * |
| 11 | 11 | 5.5 | 1.60 | 950 | 30 | 560 | 30 | 1547 | 1541 | 1551 | * |
| 21 | 21 | 5.5 | 1.20 | 880 | 8 | 560 | 20 | 1432 | 1455 | 1465 | ** |
| 22 | 22 | 5.5 | 1.20 | 1060 | 31 | 560 | 20 | 1709 | 1708 | 1718 | ** |
| 23 | 23 | 5.5 | 1.30 | 880 | 34 | 560 | 20 | 1503 | 1498 | 1508 | ** |
| 24 | 24 | 5.5 | 1.60 | 880 | 42 | 560 | 20 | 1510 | 1503 | 1513 | ** |
| 25 | 25 | 5.5 | 1.10 | 880 | 29 | 560 | 9 | 1498 | 1492 | 1502 | ** |
| 26 | 26 | 5.5 | 3.00 | 890 | 80 | 560 | 30 | 1513 | 1509 | 1519 | ** |
| 27 | 27 | 5.5 | 1.40 | 950 | 37 | 560 | 30 | 1550 | 1541 | 1551 | ** |
| 28 | 28 | 5.5 | 1.60 | 950 | 42 | 565 | 20 | 1480 | 1541 | 1551 | ** |
| 29 | 29 | 5.5 | 1.20 | 940 | 31 | 560 | 20 | 1613 | 1611 | 1621 | ** |
| 30 | 30 | 5.5 | 1.30 | 940 | 34 | 560 | 20 | 1619 | 1617 | 1627 | ** |
| 31 | 31 | 5.5 | 1.40 | 960 | 37 | 560 | 20 | 1710 | 1703 | 1713 | ** |
| 32 | 32 | 5.5 | 1.80 | 950 | 47 | 560 | 30 | 1601 | 1595 | 1605 | ** |
| 33 | 33 | 5.5 | 1.80 | 950 | 47 | 560 | 30 | 1600 | 1595 | 1605 | ** |
| 34 | 34 | 5.5 | 1.10 | 840 | 29 | 560 | 90 | 1487 | 1498 | 1508 | ** |
| 35 | 35 | 5.5 | 1.40 | 960 | 37 | 545 | 40 | 1593 | 1568 | 1578 | ** |
| 36 | 36 | 5.5 | 2.00 | 900 | 52 | 560 | 20 | 1535 | 1530 | 1540 | ** |
| 37 | 37 | 5.5 | 1.40 | 1000 | 10 | 570 | 20 | 1558 | 1563 | 1573 | ** |
| 38 | 38 | 5.5 | 1.30 | 950 | 10 | 550 | 20 | 1312 | 1596 | 1606 | ** |
| 39 | 39 | 5.5 | 1.15 | 1000 | 10 | 570 | 20 | 1590 | 1627 | 1637 | ** |

TABLE 3

| Sample No. | Steel No. | Dia. of patented wire (mm) | Dia. of finished wire (D mm) | True strain | Lubricating film | Drawing conditions (1) | (2) | (3) | (4) | DxV | TEM diffraction pattern | Properties, initial: TS (MPa) Measured | Lower limit | Upper limit | No. of twists | Longitudinal cracking | Properties, 30 days later: TS MPa | No. of twists | Longitudinal cracking |
|---|---|---|---|---|---|---|---|---|---|---|---|---|---|---|---|---|---|---|---|
| 1 | 1 | 1.00 | 0.15 | 3.79 | brass | ○ | ○ | | | 200 | halo | 4673 | 4608 | 4874 | 28 | none | 4680 | 25 | none |
| 2 | 2 | 1.70 | 0.20 | 4.28 | brass | ○ | | ○ | | 200 | halo | 4513 | 4420 | 4669 | 29 | none | 4650 | 27 | none |
| 3 | 3 | 1.70 | 0.25 | 3.83 | brass | ○ | | | ○ | 200 | halo | 4420 | 4279 | 4427 | 35 | none | 4426 | 33 | none |
| 4 | 4 | 1.50 | 0.30 | 3.22 | Cu | | ○ | ○ | | 200 | halo | 4250 | 4168 | 4255 | 30 | none | 4253 | 28 | none |
| 5 | 5 | 1.80 | 0.40 | 3.01 | brass | | ○ | | ○ | 150 | halo | 4071 | 3997 | 4084 | 35 | none | 4083 | 30 | none |
| 6 | 6 | 1.40 | 0.25 | 3.45 | brass | | | ○ | ○ | 150 | halo | 4329 | 4279 | 4333 | 36 | none | 4321 | 30 | none |
| 7 | 7 | 2.50 | 0.40 | 3.67 | Ni | ○ | ○ | ○ | | 150 | halo | 4010 | 3997 | 4032 | 33 | none | 4026 | 24 | none |
| 8 | 8 | 1.70 | 0.20 | 4.28 | brass | ○ | ○ | | ○ | 100 | halo | 4424 | 4420 | 4552 | 39 | none | 4531 | 18 | none |
| 9 | 9 | 1.30 | 0.18 | 3.95 | brass | ○ | | ○ | ○ | 100 | halo | 4490 | 4488 | 4579 | 39 | none | 4477 | 18 | none |
| 10 | 10 | 1.30 | 0.20 | 3.74 | brass | | ○ | ○ | ○ | 100 | halo | 4435 | 4420 | 4474 | 38 | none | 4470 | 18 | none |
| 11 | 11 | 1.60 | 0.22 | 3.97 | brass | ○ | ○ | ○ | ○ | 100 | halo | 4409 | 4359 | 4507 | 38 | none | 4468 | 18 | none |

TABLE 4

| Sample No. | Steel No. | Dia. of patented wire (mm) | Dia. of finished wire (D mm) | True strain | Lubricating film | Drawing conditions (1') | (2') | (3') | (4') | DxV | TEM diffraction pattern | Properties, initial: TS (MPa) Measured | Lower limit | Upper limit | No. of twists | Longitudinal cracking | Properties, 30 days later: TS MPa | No. of twists | Longitudinal cracking |
|---|---|---|---|---|---|---|---|---|---|---|---|---|---|---|---|---|---|---|---|
| 21 | 21 | 1.20 | 0.22 | 3.39 | brass | ○ | | | | 200 | halo | 4350 | 4359 | 4751 | 3 | none | 4358 | 2 | yes |
| 22 | 22 | 1.20 | 0.23 | 3.30 | brass | ○ | | | | 200 | halo | 4468 | 4331 | 4365 | 8 | yes | 4620 | 5 | yes |
| 23 | 23 | 1.30 | 0.20 | 3.74 | brass | ○ | | | | 100 | halo | 4670 | 4420 | 4655 | 3 | yes | 4721 | 3 | yes |
| 24 | 24 | 1.60 | 0.25 | 3.71 | brass | ○ | | | | 100 | halo | 4613 | 4279 | 4500 | 8 | yes | 4690 | 5 | yes |
| 25 | 25 | 1.10 | 0.14 | 4.12 | brass | | ○ | | | 200 | halo | 4921 | 4655 | 4904 | 6 | yes | 4957 | 3 | yes |
| 26 | 26 | 3.00 | 0.35 | 4.30 | brass | | ○ | | | 200 | halo | 4312 | 4075 | 4284 | 3 | yes | 4344 | 3 | yes |
| 27 | 27 | 1.40 | 0.22 | 3.70 | brass | | ○ | | | 100 | halo | 4519 | 4359 | 4507 | 2 | yes | 4653 | 3 | yes |
| 28 | 28 | 1.60 | 0.20 | 4.16 | brass | | ○ | | | 100 | halo | 4349 | 4420 | 4567 | 8 | none | 4418 | 6 | yes |
| 29 | 29 | 1.20 | 0.26 | 3.06 | brass | | | | | 240 | crystal | 4446 | 4255 | 4330 | 10 | yes | 4787 | 3 | yes |

TABLE 4-continued

| Sample No. | Steel No. | Dia. of patented wire (mm) | Dia. of finished wire (D mm) | True strain | Lubricating film | Drawing conditions (1') | (2') | (3') | (4') | DxV | TEM diffraction pattern | Properties, initial: TS (MPa) Measured | Lower limit | Upper limit | No. of twists | Longitudinal cracking | Properties, 30 days later: TS MPa | No. of twists | Longitudinal cracking |
|---|---|---|---|---|---|---|---|---|---|---|---|---|---|---|---|---|---|---|---|
| 30 | 30 | 1.30 | 0.20 | 3.74 | brass | | | | | 240 | crystal | 4530 | 4420 | 4491 | 5 | yes | 4728 | 5 | yes |
| 31 | 31 | 1.40 | 0.25 | 3.45 | brass | | | | | 240 | crystal | 4369 | 4279 | 4314 | 7 | yes | 4487 | 5 | yes |
| 32 | 32 | 1.80 | 0.35 | 3.28 | brass | ○ | ○ | ○ | ○ | 220 | crystal | 4242 | 4075 | 4162 | 6 | yes | 4287 | 4 | yes |
| 33 | 33 | 1.80 | 0.35 | 3.28 | brass | ○ | ○ | ○ | ○ | 220 | crystal | 4236 | 4075 | 4162 | 10 | yes | 4336 | 4 | yes |
| 34 | 34 | 1.10 | 0.23 | 3.13 | brass | ○ | ○ | ○ | ○ | 220 | crystal | 4156 | 4331 | 4566 | 5 | none | 4330 | 4 | yes |
| 35 | 35 | 1.40 | 0.29 | 3.15 | brass | ○ | ○ | ○ | ○ | 240 | crystal | 4613 | 4188 | 4301 | 7 | yes | 4721 | 6 | yes |
| 36 | 36 | 2.00 | 0.40 | 3.22 | brass | ○ | ○ | ○ | ○ | 240 | crystal | 4347 | 3997 | 4162 | 2 | yes | 4512 | 2 | yes |
| 37 | 37 | 1.40 | 0.20 | 3.89 | brass | | | | | 300 | crystal | 4428 | 4420 | 4539 | 16 | none | 4550 | 10 | yes |
| 38 | 38 | 1.30 | 0.18 | 3.95 | brass | | ○ | ○ | ○ | 100 | halo | 4234 | 4488 | 4589 | 32 | none | 4312 | 16 | yes |
| 39 | 39 | 1.15 | 0.15 | 4.07 | Ni | ○ | ○ | | ○ | 30 | halo | 4310 | 4608 | 4680 | 23 | none | 4572 | 11 | yes |

Note:
Sample Nos. 21 to 39 denote comparative examples.

The following are noted from Table 3 and 4. The steel wires designated at Sample Nos. 1 to 11 in Inventive examples, which were prepared by the method specified in the present invention and have tensile strength within the range specified in the present invention, do not suffer longitudinal cracking after twisting more than 28 times. Also, they do not suffer longitudinal cracking after twisting more than 18 times in the case where they are aged for 30 days. Thus they proved to be excellent in resistance to strain aging embrittlement.

On the other hand, the steel wires designated at Sample Nos. 21 to 28 in Comparative Examples, which do not meet the requirements for strength after patenting or conditions of final drawing to give a true strain in excess of 3.0, generally suffer longitudinal cracking immediately after drawing. Samples Nos. 21 and 28 do not suffer longitudinal cracking immediately after drawing; but they suffer longitudinal cracking after twisting only several times in the case where they are aged for 30 days.

The steel wires designated as Sample Nos. 29 to 36, which do not meet the requirements for the chemical composition and the rate of final drawing (greater than specified) and hence contain the lamellar cementite remaining in crystalline form, generally suffer longitudinal cracking immediately after drawing. All of them suffer longitudinal cracking after twisting only several times in the case where they are aged for 30 days.

The steel wires designated as sample Nos. 37 to 39 suffer longitudinal cracking although they meet the requirements for the chemical composition. Sample No. 37, which has specified strength, does not suffer longitudinal cracking immediately after drawing but suffers longitudinal cracking after twisting ten times in the case where they are aged for 30 days. The reason for this is that strength after patenting is not enough and the drawing rate is excessively high, and hence the lamellar cementite remains in crystalline form. Samples Nos. 38 and 39, which have excessively low strength after patenting and also have lower-than-specified strength after drawing, do not suffer longitudinal cracking immediately after drawing but suffer longitudinal cracking after twisting 11 times or 16 times (respectively) in the case where they are aged for 30 days. [Effect of the invention] The high-strength steel wire according to the present invention has a specific chemical composition, a specific diameter, a specific pearlite composition in which lamellar cementite is amorphous, and a specific tensile strength which is determined by diameter and carbon content. By virtue of these characteristic properties, it has good resistance to longitudinal cracking which usually occurs immediately after drawing or after aging. Despites its high strength, it also has good resistance to strain ageing embrittlement. The above-mentioned high-strength steel wire can be produced easily by the method according to the present invention.

What is claimed is:

1. A high-strength steel wire excellent in resistance to strain aging embrittlement and longitudinal cracking, the wire having a chemical composition (in mass %) including
C: 0.75–1.20%
Si: 0.1–1.5%,
Mn :0.3–1.2%,
P: no more than 0.02%,
S: no more than 0.02%,
Al: no more than 0.005%,
N: no more than 0.008%, and
a remainder of Fe and inevitable impurities;

a worked pearlite structure containing lamellar cementite in amorphous form;

a diameter (D) in a range of from 0.15 to 0.4 mm;

a metal lubricating film as a surface layer whose main phase comprises at least one of Cu, Ni, and Zn or an alloy thereof; and a tensile strength no lower than $3500\times D^{-0.145}$ MPa and no higher than $(3500\times D^{-0.145}+87\times[C]^{-5})$ MPa, where [C] denotes C content in %.

2. A high-strength steel wire as defined in claim 1, wherein the chemical composition further includes at least one of:

Ni: 0.10–1.0%,

Cr: 0.10–10%, and

Mo: 0.10–0.5%.

3. A high-strength steel wire as defined in claim 1, wherein the chemical composition further includes Cu: no less than 0.05% and no more than 0.20%.

4. A high-strength steel wire as defined in claim 1, wherein the chemical composition further includes Co: no more than 2.0%.

5. A high-strength steel wire as defined in claim 1, wherein the chemical composition further includes

B: 0.0003–0.0050%.

6. A method of making a high-strength steel wire, the method comprising drawing a wire rod; and producing the steel wire of claim 1.

* * * * *

UNITED STATES PATENT AND TRADEMARK OFFICE

CERTIFICATE OF CORRECTION

PATENT NO. : 6,800,147 B2
DATED : October 5, 2004
INVENTOR(S) : Nagao et al.

It is certified that error appears in the above-identified patent and that said Letters Patent is hereby corrected as shown below:

Title page,
Item [73], Assignee, should read
-- [73] Assignee: Kabushiki Kaisha Kobe Seiko Sho (Kobe Steel, Ltd.), Kobe (JP) --

Signed and Sealed this

Twenty-first Day of December, 2004

JON W. DUDAS
*Director of the United States Patent and Trademark Office*